US005597337A

United States Patent [19]

Nedderman, Jr.

[11] Patent Number: 5,597,337

[45] Date of Patent: Jan. 28, 1997

[54] QUICK CHANGE FIN ASSEMBLY FOR BUOYANT TEST VEHICLES

[75] Inventor: William H. Nedderman, Jr., Middletown, R.I.

[73] Assignee: The United States of America as represented by the Secretary of the Navy, Washington, D.C.

[21] Appl. No.: 394,109

[22] Filed: Feb. 21, 1995

[51] Int. Cl.[6] ..... A63C 15/00

[52] U.S. Cl. ..... 441/79

[58] Field of Search ..... 441/74, 79; 114/128, 114/140

[56] References Cited

U.S. PATENT DOCUMENTS

| | | | |
|---|---|---|---|
| 3,579,681 | 5/1971 | Pope, III et al. | 441/79 |
| 3,659,300 | 5/1972 | Johnson | 441/79 |
| 4,439,166 | 3/1984 | Maxwell | 441/79 |
| 4,804,347 | 2/1989 | Ross | 441/79 |
| 4,904,215 | 2/1990 | Sherwood | 441/79 |
| 5,007,868 | 4/1991 | Fry | 114/140 |
| 5,176,553 | 1/1993 | Tuttle | 441/79 |

*Primary Examiner*—Stephen Avila

*Attorney, Agent, or Firm*—Michael J. McGowan; Robert W. Gauthier; Prithvi C. Lall

[57] ABSTRACT

A quick change fin assembly for attachment to a buoyant test vehicle (BTV). The fin assembly comprises a fin body bolted to a T-shaped base portion. A resilient sheet is placed between the fin body and the base to lessen the transmission of vibrations from the fin body to the base. The assembly is attached to the truncated cone surface of the tail portion of the BTV. For each fin, a longitudinal T-shaped slot is cut into the surface of the tail portion starting from the truncated end and extending along the axis of the BTV. The T-shaped base slides into the slot from the truncated end to secure the fin assembly in a radial direction with respect to the axis of the BTV. A conical end piece is threaded onto the tail portion to clamp the fin assembly in an axial direction. The exposed surface of the T-shaped base is shaped to conform to the tail portion and to provide a smooth transition between the tail portion and the fin body.

6 Claims, 4 Drawing Sheets

QUICK CHANGE FIN ASSEMBLY FOR BUOYANT TEST VEHICLES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to fin assemblies and more particularly to quick change fin assemblies for attachment to a buoyant test vehicle (BTV), the assemblies having fin bodies bolted to a T-shaped base, the T-shaped base fitting into a T-shaped slot cut into the BTV. The fin assemblies are held in place by a BTV end piece which is attached to the BTV after the fin assemblies have been fit into the slot. When in place, the end piece closes off the T-shaped slot, preventing the release of the fin assemblies. A resilient sheet is placed between the fin body and the base to absorb noise and stress.

2. Description of the Prior Art

BTV's are used to test noise generated by shapes moving through a fluid medium. The BTV is configured to conform to the desired shape, hauled down below the water surface and released. Noise measurements are taken as the BTV rises to the surface. Depending on the release depth, the BTV can reach significant speed in rising to the surface such that it may rise to altitudes of one hundred and twenty feet after broaching the surface. Typically, the BTV then drops tail first back into the water, often breaking one or more fins when striking the water surface. The fins of prior art BTV's are bolted to the tail section of the BTV either with very long bolts extending through the fin and engaging the tail section, or with shorter bolts counter sunk in very deep bores within the fin. In prior art fin assemblies using long bolts, the long bolts bend when the BTV strikes the water surface making the removal of the fin assembly for replacement difficult. Prior art fin assemblies using shorter bolts are difficult to manufacture because of the deep bores required. In both the long bolt and short bolt prior art assemblies, the bores are filled above the bolts such that the bores do not contribute to any turbulence along the fins which would adversely impact noise measurements. Wax is typically used to fill the bores, the wax being easily pored into the bores once the bolts have been inserted. The wax is also easily removed to obtain access to the bolts in order to replace the fins. However, the use of wax requires the BTV to be removed from the water when a fin is replaced.

Removable or changeable fin assemblies are well known in the art. Such assemblies, as illustrated by Morey et al. (U.S. Pat. No. 3,516,099), typically consist of a fin and base bolted or wedged into a mounting box provided in the structure to which the fin assembly is attached. In other prior art assemblies, as illustrated by Kline (U.S. Pat. No. 2,119,881) and Fry (U.S. Pat. No. 5,007,868), a tongue and groove joint provides for the attachment of the fin assembly to the structure. Kline discloses a T-shaped keel or fin tightly engaging a corresponding rib on a rowboat. Fry discloses a tapered, dovetail-shaped groove on a fin or skeg for slidingly attaching the fin or skeg to a corresponding dovetail tongue on a marine propulsion device. With the exception of the prior art fin assemblies currently used on BTV's, the prior art removable fin assemblies do not provide the non-turbulent fin mountings necessary for conducting sensitive noise measurements. Additionally, the prior art methods for connecting the fin assemblies to the respective structures transmit vibrations from the fins to the structure. During a BTV test, such vibrations would interfere with acoustic measurements being taken.

SUMMARY OF THE INVENTION

Accordingly, it is a general purpose and object of the present invention to provide a fin assembly for a BTV that allows damaged or broken fins to be replaced without having to take the BTV out of the water.

It is a further object that the fin assembly provide acoustic isolation between the fin and the body of the BTV.

Another object is that the fin assembly facilitate easy removal and replacement of fins for experimental testing of fin shapes and fin mounting methods.

These objects are accomplished with the present invention by providing a quick change fin assembly for attachment to the truncated cone surface of the tail portion of a BTV. For each fin, a longitudinal T-shaped slot is cut into the surface of the tail portion starting from the truncated end and extending along the axis of the BTV. The fin assembly comprises a fin body bolted to a T-shaped base portion. A resilient sheet is placed between the fin body and the base to absorb noise and stress. The exposed surface of the T-shaped base is shaped to conform to the tail portion and to provide a smooth transition between the tail portion and the fin body. The base slides into the slot from the truncated end to secure the fin assembly in a radial direction with respect to the axis of the BTV. A conical end piece is threaded onto the tail portion to clamp the fin assembly in an axial direction. The fin assembly thus described allows a broken fin body to be easily replaced by removing the conical end piece, sliding the base from the tail portion and unbolting the broken fin body. A new fin body is attached to the base and the base is slid back into the tail portion and the end piece is reattached. The operation can be accomplished while the BTV remains in the water.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
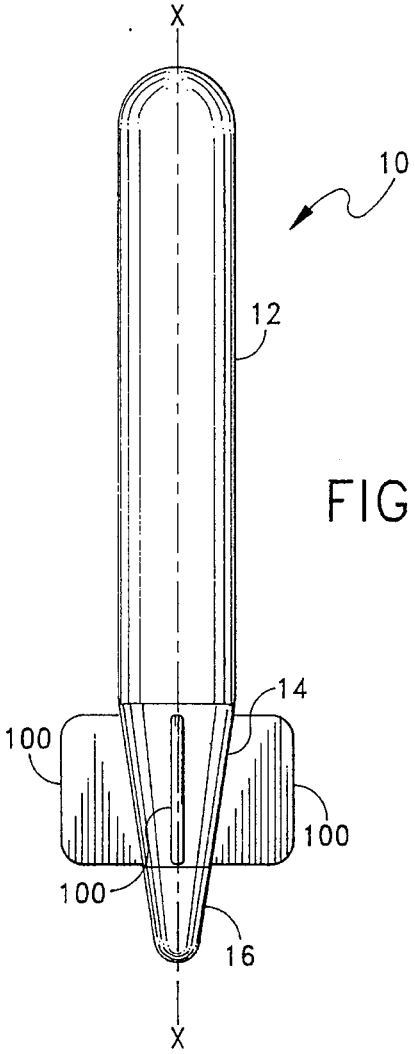
FIG. 1 shows a BTV with quick change fin assemblies attached thereto.
Figure 2:
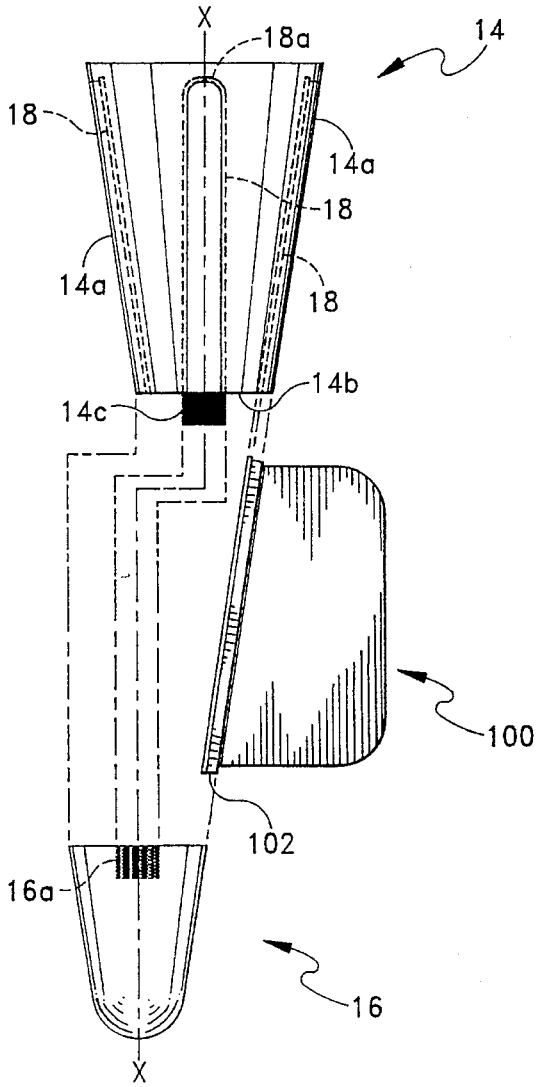
FIG. 2 shows an expanded view of a tail portion of a BTV, an end piece of a BTV and a fin assembly.

Referring now to FIG. 1, there is shown BTV 10 having quick change fin assemblies 100 attached. Forward portion 12 of BTV 10 is cylindrical having its longitudinal axis at X—X. Tail portion 14 is a truncated cone about X—X, tapering from forward portion 12 to removable end piece 16. End piece 16 is conically shaped about X—X, matching the taper of tail portion 14. Fin assemblies 100 are attached to tail portion 14 in a manner to be further described. Referring now to FIG. 2, tail portion 14, end piece 16 and fin assembly 100 are shown in an expanded view. T-shaped slots 18 are milled into surface 14*a* of tail portion 14. The preferred embodiment of FIG. 2 comprises four slots 18 equally spaced about axis X—X corresponding to four fin assemblies 100. Only one fin assembly is shown in FIG. 2 to illustrate how fin assemblies are mated to tail portion 14. The number and spacing of slots 18 and corresponding fin assemblies 100 can be varied to suit the desired configuration of BTV 10. Slots 18 begin at truncated cone end 14*b* of tail portion 14 and extend longitudinally along surface 14*a* ending at semicircular ends 18*a* of slot 18, a distance apart from forward end 12 (not shown). Fin base 102 of fin assembly 100 is T-shaped to correspond with T-shaped slot 18. In the preferred embodiment of the present invention, fin base 102 is fabricated of a hard polymer material such as Delrin. Fin base 102 is slid into slot 18 from truncated cone end 14*b*. Threaded extension 14*c* of tail portion 14 extends from truncated cone end 14*b* along axis X—X. With fin assemblies 100 within corresponding slots 18, threaded aperture 16*a* of end piece 16 is threaded onto threaded extension 14*c* to retain fin assemblies 100 within slots 18.

Figure 3:
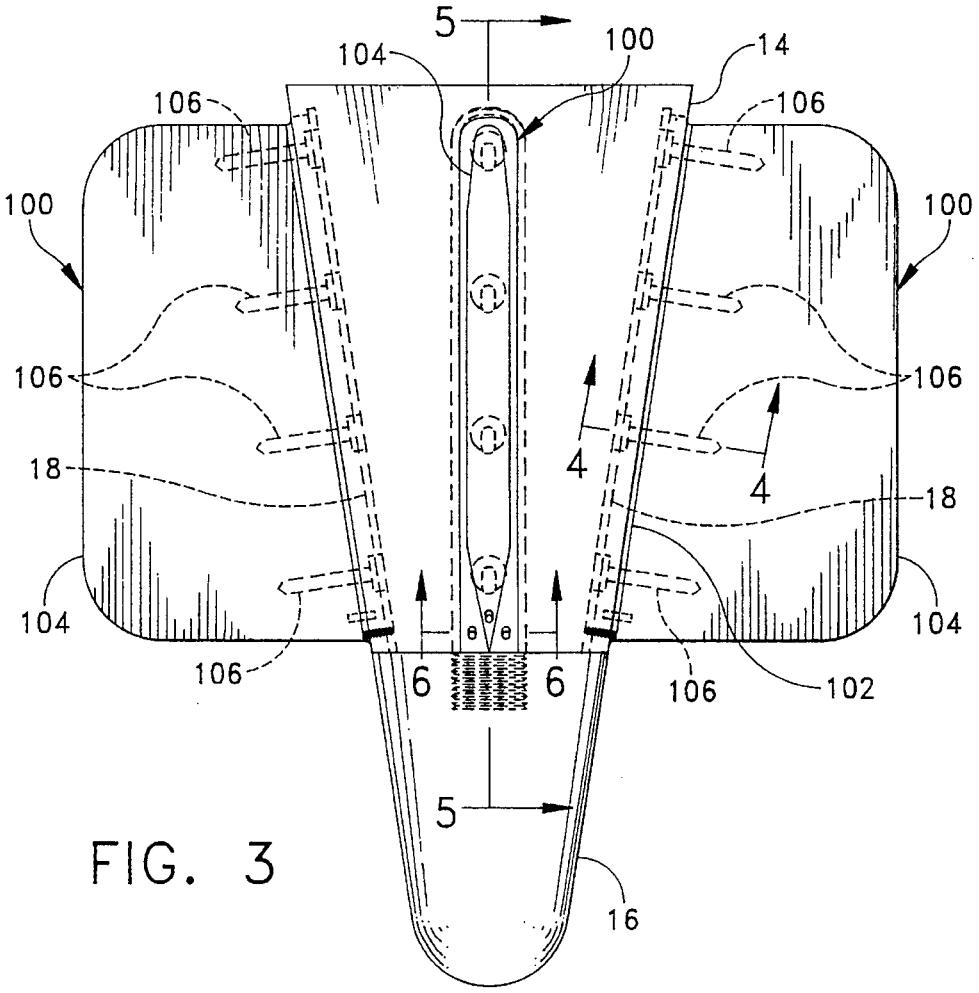
FIG. 3 shows a view of an end piece and a tail portion of a BTV with quick change fin assemblies attached to the BTV.
Figure 4:
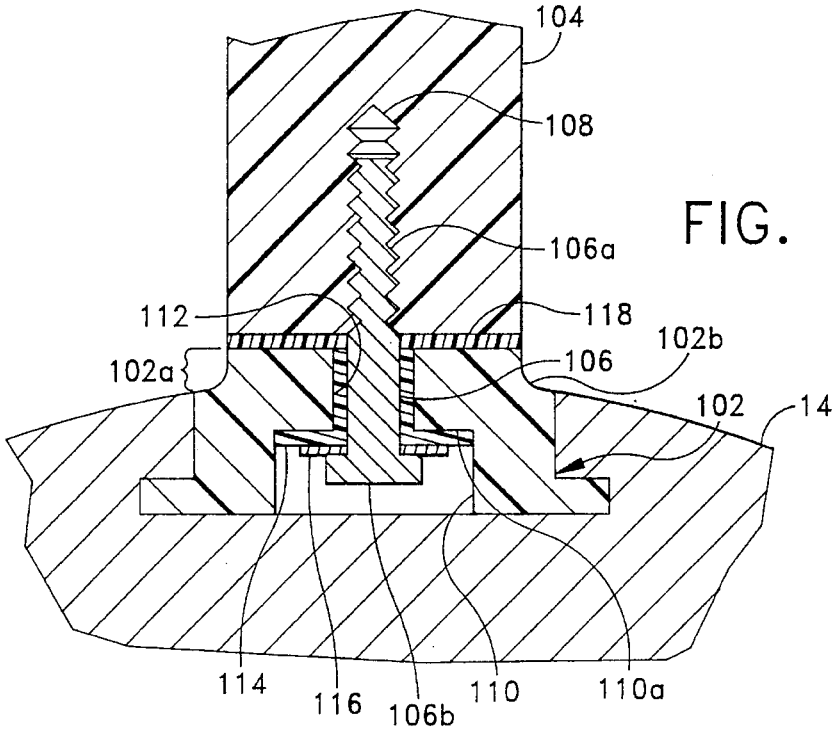
FIG. 4 shows a sectional view of a tail portion of a BTV with a quick change fin assembly attached thereto taken at 4—4 of FIG. 3.

Referring now to FIG. 3, there is shown tail portion 14 of BTV 10 with fin assembly 100 and end piece 16 attached thereto. Fin base 102 is retained in slot 18 by end piece 16. Fin body 104 of fin assembly 100 is fixedly attached to fin base 102 by means of bolts 106. Referring now additionally to FIG. 4, there is shown a section taken at 4—4 of FIG. 3. In the preferred embodiment of the present invention, fin body 104 is cast from an inexpensive epoxy resin. Fin body aperture 108 is drilled into fin body 104 and tapped to accept threaded portion 106*a* of bolt 106. Counterbore 110 is provided in fin base 102 for countersinking bolt 106 within fin base 102. Bolt aperture 112 is larger than bolt 106 to accept bushing 114 which surrounds bolt 106 and rests against base 110*a* of counterbore 110. Washer 116 is provided to bear against bushing 114 when bolt 106 is tightened with nut end 106*b* of bolt 106. Thin resilient membrane 118 is positioned between base 102 and fin body 104. Together with bushing 114, membrane 118 absorbs localized stress and isolates fin vibrations from tail portion 14. Raised boss 102*a* is provided in base 102 to provide a smooth continuous surface with fin body 104. Fillets 102*b* are provided in base 102 to smoothly blend tail portion 14, boss 102*a* and fin body 104.

Figure 5:
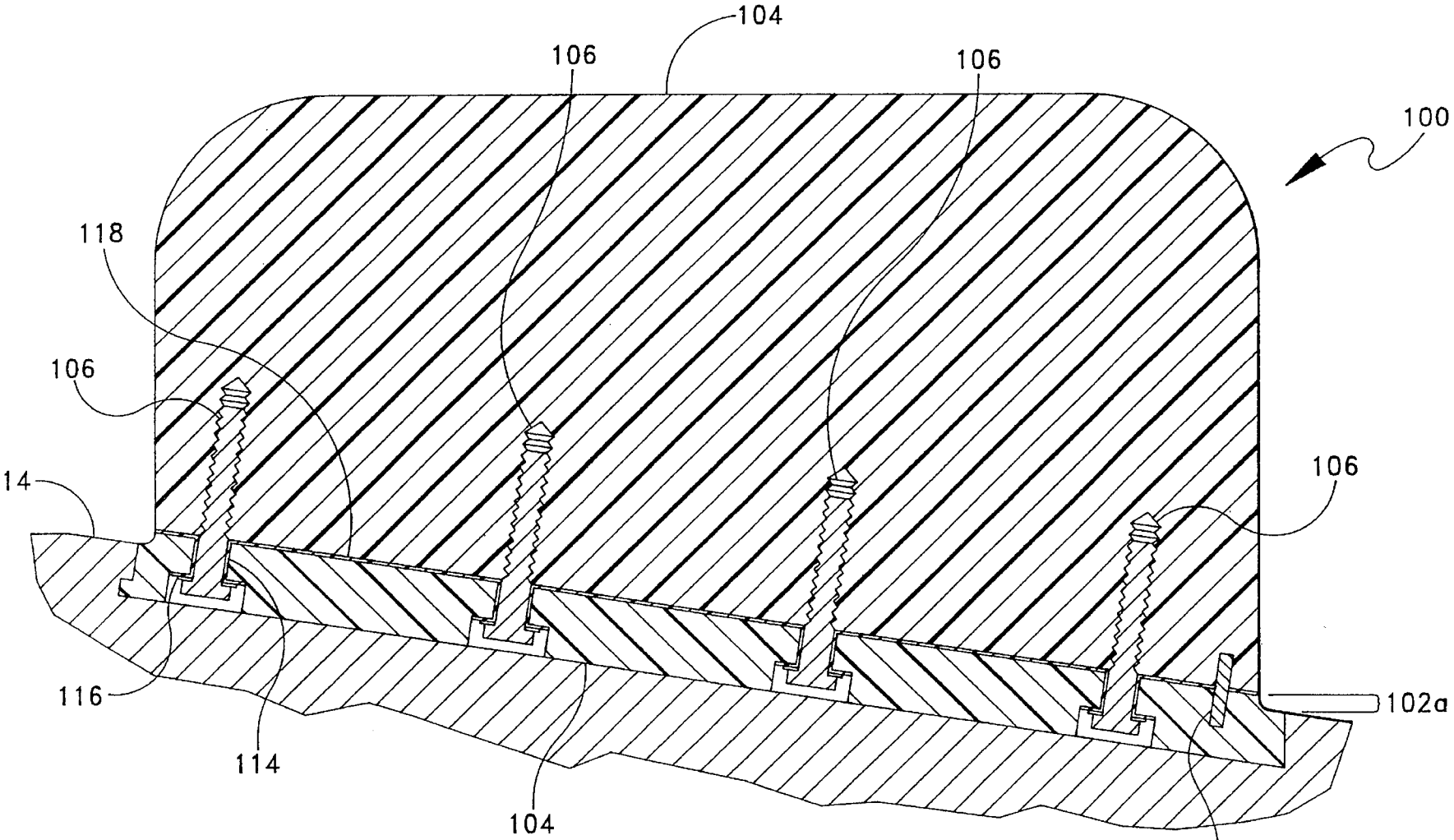
FIG. 5 shows a sectional view of an end piece and a tail portion of a BTV with a quick change fin assembly attached to the tail portion taken at 5—5 of FIG. 3.
Figure 6:
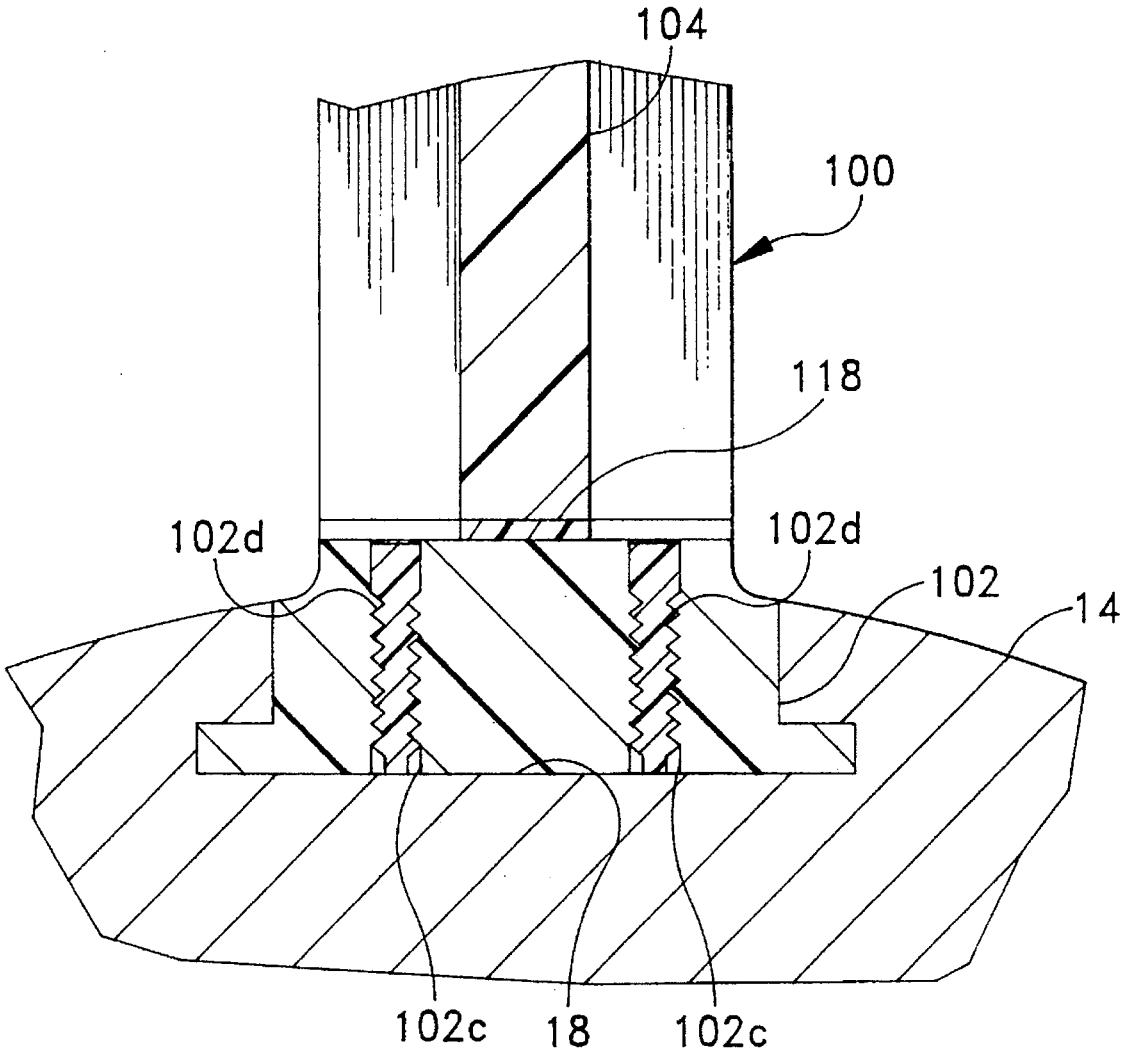
FIG. 6 shows a sectional view of an end piece and a tail portion of a BTV with a quick change fin assembly attached to the tail portion taken at 6—6 of FIG. 3.

Referring now to FIG. 5, there is shown a sectional view of fin assembly 100 within tail portion 14 taken at 5—5 of FIG. 3. Membrane 118 is seen to extend the full length of fin body 104 and boss 102*a* extends the full length of base 102. In the preferred embodiment of FIG. 5, four bolts 106 are provided to connect fin body 104 to base 102. Each bolt 106 has a bushing 114 and a washer 116. In a preferred embodiment, pin 120 extends into corresponding bores in fin body 104 and base 102 to maintain alignment of fin body 104 with base 102. Referring now additionally to FIG. 6 there is shown a sectional view of fin assembly 100 within tail portion 14 taken at 6—6 of FIG. 3. Threaded set screw apertures 102*c* are provided to either side of fin body 104. Nylon tipped set screws 102*d* are screwed into each screw aperture 102*c* and engage tail portion 14 to ensure base 102 is properly aligned and fits tightly within slot 18.

The assembly of the present invention has many advantages over the prior art. If a fin body 104 is damaged during a test run, replacement can be easily accomplished without removing BTV 10 from the water. End piece 16 is unscrewed from tail portion 14 leaving slot 18 open at truncated cone end 14*b*. Fin base 102 is then slid out of slot 18 and bolts 106 are removed to free damaged fin body 104 from fin base 102. A new fin body 104 is attached to fin base 102 by means of bolts 106 and fin base 102 is slid back into slot 18. End piece 16 is screwed back onto tail portion 14 to complete the repair. The same method is used to quickly test various configurations for fin body 104. Further, bushings 114 and resilient membrane 118 effectively isolate fin assembly 100 from BTV 10 to assure that fin vibrations will not interfere with sensitive acoustic measurements taken during a test run of BTV 10.

What has thus been described is a quick change fin assembly allowing for easy replacement of a damaged fin body. The assembly comprises a fin body bolted to a T-shaped base. The bolts extend from a countersunk bore in the bottom the T-shaped base, through the base and into the fin body. The T-shaped base fits into a T-shaped slot cut into the structure to which the fin is to be mounted. The slot is cut into the surface of the structure leaving one end of the slot open for inserting the T-shaped base. The base is slid into the slot from the open end and a closure piece is attached to the structure closing off the end of the slot and preventing the base from being removed from the slot. In the preferred embodiment of the present invention, the structure is a buoyant test vehicle used in acoustic testing of underwater vehicles. To prevent vibrations from the fin body from interfering with sensitive noise measurements, a resilient sheet is placed between the fin body and the base to absorb noise and stress. Further, a resilient bushing is provided in the countersunk bores to isolate the bolts from the base thus preventing the transmission of fin body vibrations through the bolts.

Obviously many modifications and variations of the present invention may become apparent in light of the above teachings. For example, the fin body can be fabricated of any suitable material provided the fin body is strong enough to resist the induced stress during the BTV test run yet not so strong as to cause bending of the bolts holding the fin body to the base when the BTV strikes the water surface. Similarly, the base may be fabricated of any material sufficiently strong to maintain the assembly rigidly within the slot during a BTV test run and not sustain damage when the BTV strikes the water surface and a fin body is damaged. Also the shape of the base and corresponding slot can be varied so long as the shape of the base serves to firmly hold the base within the slot.

In light of the above, it is therefore understood that within the scope of the appended claims, the invention may be practiced otherwise than as specifically described.

What is claimed is:

1. An assembly for attaching a replaceable fin to a body of the type having a groove extending along a surface of the body for slidably and removably receiving the assembly, the body further having a removable end piece for retaining the assembly with reference to a direction along the groove, the assembly comprising:

a fin base plate slidably and removably inserted into the groove of the body, the base plate engaging with a groove surface for retaining the base plate with reference to a direction perpendicular to the groove;

a fin structure removably attached to the base plate, the fin structure extending from the base plate in a direction away from the surface of the body;

at least one bolt extending through the base plate, the at least one bolt engaging at least one corresponding threaded bore in the fin structure for removably attaching the fin structure to the base plate; and a vibration absorbing bushing between the base plate and the at least one bolt.

2. The assembly of claim 1 further comprising a vibration absorbing material between the base plate and the fin structure, the vibration absorbing material corresponding in shape to the fin structure adjacent to the base plate.

3. The assembly of claim 1 wherein the base plate is shaped to provide a smooth transition between the surface of the body and the fin structure.

4. The assembly of claim 2 wherein the base plate is shaped to provide a smooth transition between the surface of the body and the fin structure.

5. An assembly for attaching a replaceable fin to a body of the type having a groove extending along a surface of the body for slidably and removably receiving the assembly, the body further having a removable end piece for retaining the assembly with reference to a direction along the groove, the assembly comprising:

a fin base plate slidably and removably inserted into the groove of the body, the base plate engaging with a groove surface for retaining the base plate with reference to a direction perpendicular to the groove;

a fin structure removably attached to the base plate, the fin structure extending from the base plate in a direction away from the surface of the body; and a vibration absorbing material between the base plate and the fin structure, the vibration absorbing material corresponding in shape to the fin structure adjacent to the base plate.

6. An assembly for attaching a replaceable fin to a body of the type having a groove extending along a surface of the body for slidably and removably receiving the assembly, the assembly comprising:

a fin base plate slidably and removably inserted into the groove of the body, the base plate engaging with the body for retaining the base plate with reference to a direction perpendicular to the groove;

a fin structure removably attached to the base plate, the fin structure extending from the base plate in a direction away from the surface of the body;

a removable end piece for retaining the assembly with reference to a direction along the groove; and an alignment pin means for maintaining the fin structure and the base in relative alignment, the pin means being received within a first alignment bore in the base plate and extending from the first alignment bore into a second alignment bore in the fin structure.

* * * * *